US005514189A

United States Patent [19]

Farng et al.

[11] Patent Number: 5,514,189

[45] Date of Patent: May 7, 1996

[54] DITHIOCARBAMATE-DERIVED ETHERS AS MULTIFUNCTIONAL ADDITIVES

[75] Inventors: Liehpao O. Farng, Lawrenceville; Andrew G. Horodysky; Richard N. Nipe, both of Cherry Hill, all of N.J.

[73] Assignee: Mobil Corporation, Fairfax, Va.

[21] Appl. No.: 289,078

[22] Filed: Aug. 11, 1994

Related U.S. Application Data

[62] Division of Ser. No. 986,654, Dec. 8, 1992, abandoned.

[51] Int. Cl.[6] ..... C10L 1/22

[52] U.S. Cl. ..... 44/383

[58] Field of Search ..... 44/383

[56] References Cited

U.S. PATENT DOCUMENTS

| | | | |
|---|---|---|---|
| 2,396,789 | 3/1946 | Hunt | 260/455 |
| 2,637,696 | 5/1953 | Kirshenbaum et al. | 252/47.5 |
| 3,265,562 | 8/1966 | Watts | 167/22 |
| 3,412,026 | 11/1968 | Booher | 252/33.3 |
| 3,462,368 | 8/1969 | Wollensak | 252/46.7 |
| 3,682,980 | 8/1972 | Braid et al. | 260/396 R |
| 4,584,810 | 4/1986 | Hill | 52/648 |
| 4,761,482 | 8/1988 | Karol | 548/142 |
| 5,126,063 | 6/1992 | Cardis et al. | 252/46.3 |

FOREIGN PATENT DOCUMENTS

| | | | |
|---|---|---|---|
| 525670 | 8/1976 | U.S.S.R. | 558/236 |
| 558910 | 5/1977 | U.S.S.R. | 538/236 |

*Primary Examiner*—Jacqueline V. Howard
*Attorney, Agent, or Firm*—Malcolm D. Keen; Dennis P. Santini; Charles A. Malone

[57] ABSTRACT

Dialkyl dithiocarbamate-derived organic ethers have been found to be effective antiwear/antioxidant additives for lubricants or fuels.

12 Claims, No Drawings

DITHIOCARBAMATE-DERIVED ETHERS AS MULTIFUNCTIONAL ADDITIVES

This is a division of application Ser. No. 07/986,654, filed on Dec. 8, 1992 now abandoned.

BACKGROUND OF THE INVENTION

1. Field of the Invention

This invention is directed to dithiocarbamate-derived ethers as lubricant additives and to lubricant compositions containing same. The dithiocarbamate-derived ethers are also believed to be highly useful in fuel application 2. Description of Related Art The use of metallic dithiocarbamates (such as zinc, nickel or lead dialkyl dithiocarbamates) has been known as effective antioxidants and antiozonants for many years in various kinds of rubber and polymer applications, such as SBR [styrene-butadiene rubber (copolymer)] and NBR [acrylonitrile-butadiene rubber (copolymer)].

The use of non-metallic (ashless) dithiocarbamates, such as 4,4-methylene bis (dibutyl dithiocarbamate), has been widely reported for their antioxidant and load carrying properties in lubricant applications.

The use of organic ethers, such as diphenyl ether and alkylated diphenyl ethers, has been well known as having beneficial thermal-oxidative stability, good surface property and excellent lubricity.

The use of dithiocarbamate ethers in the preparation of herbicidal and plant growth regulants is disclosed in U.S. Pat. No. 4,584,810.

It has now been found that the use of these dithiocarbamate-derived organic ethers provides exceptional antiwear/EP and antioxidant activity with potential high temperature stabilizing and metal deactivating properties. Additional cleanliness/detergency, fuel economy improving/friction reducing, corrosion inhibiting and anti-fatigue properties are expected.

BRIEF SUMMARY OF THE INVENTION

This application is directed to lubricant compositions containing small additive concentrations of N, N-dihydrocarbyl dithiocarbamate-derived ethers which possess excellent antiwear/antioxidant properties coupled with good extreme pressure load-carrying activities.

Both the dithiocarbamate moiety and the ether moiety are believed to provide the basis for the synergistic antiwear activity. The dithiocarbamate group is also believed to contribute significant antioxidant performance to these novel additives.

To summarize, it is expected that the performance benefits will include antifatigue, antispalling, antistaining, antisquawking, improved additive solubility, improved load carrying/bearing, extreme pressure, improved thermal and oxidative stability, friction reducing, antiwear, anticorrosion, cleanliness improvingg, low- and high-temperature antioxidant, emulsyfying/demulsifying, detergency and antifoaming properties.

All of these beneficial properties are believed to be enhanced as a result of this novel internal synergism. This unique internal synergism concept is believed to be applicable to similar structures containing (a) dithiocarbamate groups, (b) ether groups within the same molecule. The products of this invention show good stability and compatibility when used in the presence of other commonly used additives in lubricant compositions.

This invention is more particularly directed to lubricant compositions comprising a major amount of an oil of lubricating viscosity or grease prepared therefrom and a minor multifunctional amount of an additive comprising a N,N-dihydrocarbyl (preferably alkyl) dithiocarbamate-derived ether.

DESCRIPTION OF THE PREFERRED EMBODIMENTS

The sodium dialkyl dithiocarbamates may be synthesized by reacting an equimolar amount of sodium hydroxide and a secondary dihydrocarbylamine, and slightly excess carbon disulfide in either aqueous media or organic solution depending on conditions (Equation 1).

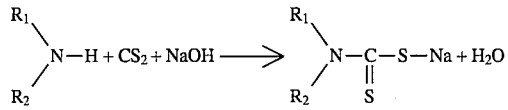

(1)

Similarly, triethylammonium salts (or other trialkylammonium salts) can be made by reacting triethylamine (or other appropriate tertiary amines), dihydrocarbylamine and carbon disulfide in the similar non-aqueous media (Equation 2)

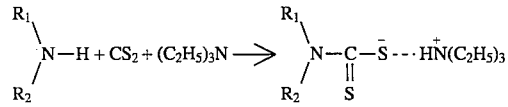

(2)

Haloalkyl ethers (such as 2-chloroethyl methyl ether or 2-chloroethyl ether) were reacted with either sodium salts or triethyl ammonium salts of dihydrocarbyl dithiocarbamates to form N,N-dihydrocarbyl dithiocarbamate-derived organic ethers as generally described in Equation 3.

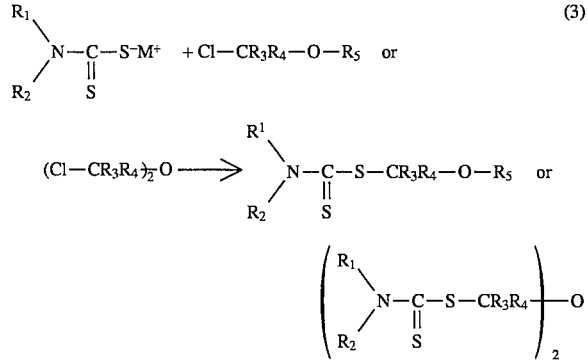

(3)

Where $R_1$, $R_2$ are hydrogen, or $C_1$ to about $C_{60}$ hydrocarbyl; $R_3$, $R_4$, $R_5$ are hydrogen, or $C_1$ to about $C_{18}$ hydrocarbyl. $M^+$ represents the cationic moiety of dithiocarbamate salt, such as sodium ion ($Na^+$), triethylammonium ion [$(C_2H_5)3N^+H$], or other suitable cations.

A non-limiting list includes potassium ion (K+), cuprous ion (Cu+),cupric ion (Cu+2), antimony ion (Sb+3, zinc ion (Zn+2) and trimethylammonium ion, trbutylammonium ion, etc.

Other suitable haloalkyl ethers such as the described chloroethers and bromoethers are also available for these types of reactions include but are not limited to 2-bromoethyl methyl ether, 2-chloroethyl butyl ether, 2-chloroprophyl ether, etc.

Other suitable dihydrocarbylamines include but are not limited to diethylamine, diisopropylamine, di-(2-ethylhexyl) amine, dicocoamine, etc.

Other suitable hydrocarbylammonium salts include but are not limited to diethyl-dithiocarbamate trimethyl ammonium salt, diethyl-dithiocarbamate tributyl ammonium salt, dibutyl-dithiocarbamate tributyl ammonium salt, etc. The dithiocarbamates described above can be synthesized by any method known to the art and is not limited to the method disclosed herein.

The hydrocarbylamines used in the invention can include but are not limited to the following amines: dialkylamines such as dibutylamine or any $C_1$ to about $C_{32}$ dihydrocarbylamine and trialkylamines such as triethylamine.

Conditions for the above reactions may vary widely depending upon specific reactants, the presence or absence of a solvent and the like. Any suitable set of reaction conditions known to the art may be used. Generally, stoichiometric quantities of reactants are used. However, equimolar, more than molar or less than molar amounts may be used. The reaction temperature may vary from ambient to about 250° C. or reflux, the pressure may vary from ambient or autogenous to about 500 psi and the molar ratio of reactants preferably varies from about 1:1 moles to about 10:1 moles. An excess of one reagent or another can be used. However, the most promising stoichiometry is one mole of dithiocarbamate salt to one mole of monochloroether, and two moles dithiocarbamate salt to one mole of dichloroether for many of the commonly used lubricant applications.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SUS at 100° F. to about 6,000 SUS at 100° F. and preferably, from about 50 to about 250 SUS at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, and phenoxy phenylethers.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, non-metallic or metallic phosphorodithioates and the like. These materials do not detract from the value of the compositions of this invention, rather the materials serve to impart their customary properties to the particular compositions in which they are incorporated.

The additive reaction products hereof can be conviently used in liquid hydrocarbon or oxygenated fuels or mixtures thereof, including alcoholic fuels and diesel fuels and fuel oils. Generally they are used in fuels in quantites of about 1 to aboutt 1,000 pounds of additive to 1,000 barrels of fuel and preferably from about 10 to bout 250 pounds per 1,000 barrels.

The following examples are merely illustrative and are not meant to be limitations.

EXAMPLE 1

The Preparation of Sodium N,N-Dibutyl Dithiocarbamate Aqueous Solution

Approximately 516 g of dibutylamine (4.0 moles), 600 ml water, and 160 g of sodium hydroxide (4.0 moles) were charged in a three-liter, four-neck flask. Slowly, 320 g of carbon disulfide (4.21 moles) was added dropwise through a dropping funnel to the agitated reactants over a two-hour period. The resulting exotherm was controlled with an ice-water bath to keep the reaction temperature below 35° C. At the end of the addition, the reaction mixture was gradually heated up to 80° C. to drive out excess carbon disulfide. It was further diluted with more water to make up a total of 2000 g aqueous solution of sodium dibutyl dithiocarbamate (45.4 wt %).

EXAMPLE 2

The Preparation of N,N-Dibutyl Dithiocarbamate S-Methoxyethane

Approximately 500 g (1.0 mole) aqueous sodium dibutyl dithiocarbamate, 300 ml heptane, 5.0 g Aliquat 336 (phase transfer catalyst), and 94.5 g (1.0 mole) 2-chloroethyl methyl ether, were charged in a reactor. The reaction mixture was reacted at ambient temperature for about two hours, and then it was further reacted at 65° C. for eight hours. Thereafter, the organic phase was separated from the aqueous phase, and was twice washed with dilute caustic solution (2N, 2×300 ml), and twice washed with water (2×300 ml). Then, the organic solution was dried over anhydrous magnesium sulfate and filtered. Finally, the volatiles were removed under reduced pressure using a rotary evaporator, leaving the product as a yellowish fluid (268 g).

EXAMPLE 3

The Preparation of Bis-N,N-Dibutyl Dithiocarbamate S-Ethyl Ether

Approximately 1000 g (2.0 mole) aqueous sodium dibutyl dithiocarbamate, 300 ml heptane, 6.0 g Aliquat 336 (phase transfer catalyst), and 141.5 g (1.0 mole) 2-chloroethyl ether, were charged in a reactor. The reaction mixture was reacted at ambient temperature for about three hours, and then it was further reacted at 70° C. for eight hours. Thereafter, the organic phase was separated from the aqueous phase, and was twice washed with dilute caustic solution (2N, 2×300 ml), and twice washed with water (2×300 ml). Then, the organic solution was dried over anhydrous magnesium sulfate and filtered. Finally, the volatiles were removed under reduced pressure using a rotary evaporator, leaving the product as a yellowish fluid (456 g).

EVALUATION OF PRODUCT

These ashless dithiocarbamate derived ethers were blended into mineral oils and evaluated for antioxidant performance using the Catalytic Oxidation Test at 325° F. for 40 hours; and the Catalyst Oxidation Test at 325° F. for 72 hours (Tables 1 and 2).

The Catalytic Oxidation Test may be summarized as follows: Basically, the lubricant is subjected to a stream of air which is bubbled through the oil formulation at the rate of five liters per hour at 325° F. for 40 hours and at 325° F. for 72 hours. Present in the composition are samples of metals commonly used in engine construction, namely iron, copper, aluminum and lead, see U.S. Pat. No. 3,682,980 incorporated herein by reference for further details.

TABLE 1

| Catalytic Oxidation Test (325° F., 40 Hours) | | | | |
|---|---|---|---|---|
| Item | Additive Conc. (wt %) | % Change in Viscosity Δ KV, % | Change in Acid No., Δ TAN | Sludge Rating |
| Base oil (200 second, solvent refined, paraffinic neutral oil) | — | 232.0 | 15.3 | Heavy |
| Example 2 | 1.0 | 45.2 | 3.18 | Heavy |
| Example 3 | 1.0 | 24.5 | 2.20 | Heavy |

TABLE 2

| Catalytic Oxidation Test (325° F., 72 Hours) | | | | |
|---|---|---|---|---|
| Item | Additive Conc. (wt %) | % Change in Viscosity Δ KV, % | Change in Acid No., Δ TAN | Sludge Rating |
| Base oil (200 second, solvent | — | 4044.0 | 17.9 | Heavy |

TABLE 2-continued

| Catalytic Oxidation Test (325° F., 72 Hours) | | | | |
|---|---|---|---|---|
| Item | Additive Conc. (wt %) | % Change in Viscosity Δ KV, % | Change in Acid No., Δ TAN | Sludge Rating |
| refined, paraffinic neutral oil) | | | | |
| Example 2 | 1.0 | 63.4 | 5.52 | Heavy |
| Example 3 | 1.0 | 40.8 | 4.20 | Heavy |

As shown above, the products of this invention show very good antioxidant characteristics as evidenced by the control of increase in acidity and viscosity.

The products of Examples were also evaluated for antiwear performance in industrial oils using the Four-Ball Test (Table 3).

In the Four Ball Wear Test, three stationary balls are placed in a lubricant cup and a lubricant containing the compound to be tested is added thereto, and a fourth ball is placed in a chuck mounted on a device which can be used to spin the ball at known speeds and loads. The examples were tested using half inch stainless steel balls of 52100 steel for thirty minutes under 30 kg load at 1800 rpm and 200° F. If additional information is desired consult test method ASTM D2266 and/or U.S. Pat. No. 4,761,482.

TABLE 3

| Four-Ball Wear Test | | | |
|---|---|---|---|
| | Wear Scar Diameter in MM, 30 Minute Test 200° F. | | |
| Item | 60 Kg 1500 rpm | 60 Kg 2000 rpm | 40 Kg 1800 rpm |
| Base oil (80% solvent paraffinic bright, 20% solvent paraffinic neutral mineral oils) | 2.12 | 3.25 | 0.733 |
| 1% Example 2 | — | 1.775 | 0.563 |
| 1% Example 3 | 0.796 | — | 0.579 |

As can be seen from the above wear test results, the products exhibit considerable antiwear activity.

These dithiocarbamate-derived ether products also show no deleterious effect on corrosivity to the base oil (Table 4).

The Copper Strip Corrosivity Test (ASTM D-130) measures a product's propensity to corrode copper due, for example, to constrained sulfur groups.

TABLE 4

| Copper Strip Corrosivity Test (3 Hours, 250° F.) ASTM D-130 | | |
|---|---|---|
| Item | Additive Conc. (wt %) | Corrosivity Rating |
| Base oil (solvent refined, paraffinic neutral) | — | 1a |
| Example 2 | 1.0 | 1a |
| Example 3 | 1.0 | 1b |

The use of additive concentrations of dithiocarbamate-derived ethers in premium quality industrial and automotive lubricants will significantly enhance the stability, improve load-carrying, reduce the wear, and extend the service life. These novel compositions described in this invention are useful at low concentrations and do not contain any of the potentially undesirable metals or phosphorus.

Although the present invention has been described with preferred embodiments, it is to be understood that modifications and variations may be resorted to without departing from the spirit and scope of this invention, as those skilled in the art will readily understand. Such variations and modifications are considered within the purview and scope of the appended claims.

What is claimed is:

1. An improved fuel composition comprising a major proportion of a liquid hydrocarbon or oxygenated fuel or mixtures thereof and a minor multifunctional antiwear, extreme pressure, antioxidant and corrosion inhibiting proportion of an N,N-dihydrocarbyl dithiocarbamate-derived organic ether additive product of reaction which has the following formula:

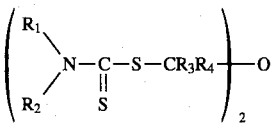

where $R_1$, $R_2$ are hydrogen, or $C_1$ to about $C_{60}$ hydrocarbyl; $R_3$ and $R_4$ are hydrogen, or $C_1$ to about $C_{18}$ hydrocarbyl; and hydrocarbyl is selected from a member or the group consisting of alkyl, alkenyl, aryl, alkaryl, aralkyl which optionally contains O, N, S or mixtures thereof.

2. The composition of claim 1 wherein the dihydrocarbyl dithiocarbamate-derived ether additive product of reaction is prepared in the following manner:

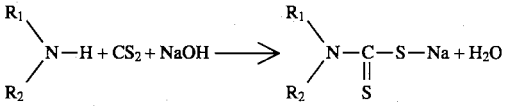

(1)

or

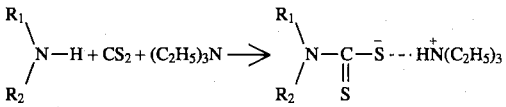

(2)

followed by

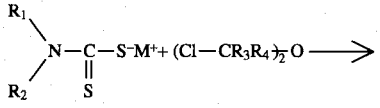

(3)

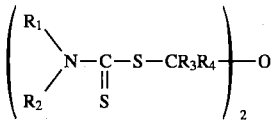

where $R_1$, $R_2$ are hydrogen, or $C_1$ to about $C_{60}$ hydrocarbyl; $R_3$ and $R_4$ are hydrogen, or $C_1$ to about $C_{18}$ hydrocarbyl; $M^+$ represents Na or $H^+N(C_2H_5)_3$, and hydrocarbyl is selected from the group consisting of alkyl, alkenyl, aryl, alkaryl, aralkyl which may optionally contain O, N, S or mixtures thereof and wherein the reaction is carried out at temperatures varying from ambient to about 250° C. under pressures varying from ambient or autogenous for a time sufficient to obtain the desired additive product of reaction and where the reaction is carried out in molar ratios of reactants varying from equimolar to more than molar to less than molar.

3. The composition of claim 1 wherein the additive reaction product thereof is prepared from aqueous sodium dibutyl dithiocarbamate and 2-chloroethyl methyl ether.

4. The composition of claim 1 wherein the additive reaction product thereof is prepared from aqueous sodium dibutyl dithiocarbamate and 2-chloroethyl ether.

5. The comoposition of claim 1 wherein the fuel is selected from the group consisting of gasolines, alcohlic fuels, other oxygenated fuels or mixtures thereof and distillate fuels.

6. The composition of claim 5 wherein the fuel contains from about 1 to about 1,000 pounds, based on the total weight of the composition, of the additive product of reaction.

7. A process of preparing a multifunctional antiwear, extreme pressure, antioxidant and corrosion inhibiting additive product which is prepared in the following manner:

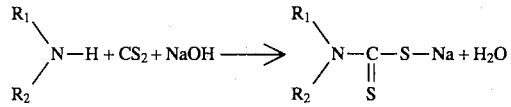

(1)

or

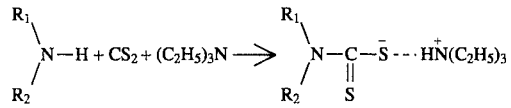

(2)

followed by

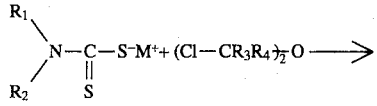

(3)

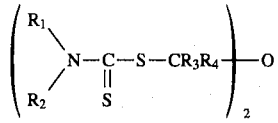

where $R_1$, $R_2$ are hydrogen, or $C_1$ to about $C_{60}$ hydrocarbyl; $R_3$ and $R_4$ are hydrogen, or $C_1$ to about $C_{18}$ hydrocarbyl; $M^+$ represents Na or $H^+N(C_2H_5)_3$, and hydrocarbyl is selected from the group consisting of alkyl, alkenyl, aryl, alkaryl, aralkyl which may optionally contain O, N, S or mixtures thereof and wherein the reaction is carried out at temperatures varying from ambient to about 250° C. under pressures varying from ambient to autogenous for a time sufficient to obtain the desired additive product of reaction and where the reaction is carried out in molar ratios of reactants varying from equimolar to more than molar to less than molar.

8. The process of claim 7 wherein the additive product is prepared from aqueous sodium dibutyl dithiocarbamate and 2-chloroethyl methyl ether.

9. The process of claim 7 wherein the additive product is prepared from aqueous sodium dibutyl dithiocarbamate and 2-chloroethyl ether.

10. A multifunctional antiwear, antioxidant, extreme pressure, corrosion inhibiting additive product of reaction prepared in the following manner:

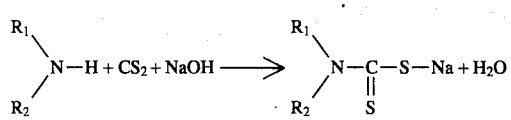

(1)

or

-continued

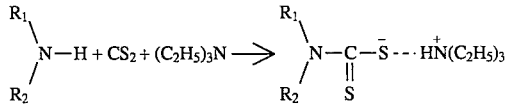

(2)

followed by

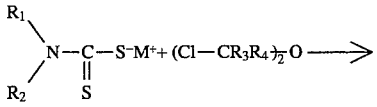

(3)

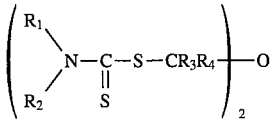

where $R_1$, $R_2$ are hydrogen, or $C_1$ to about $C_{60}$ hydrocarbyl; $R_3$ and $R_4$ are hydrogen, or $C_1$ to about $C_{18}$ hydrocarbyl; $M^+$ represents Na or $H^+N(C_2H_5)_3$, and hydrocarbyl is selected from the group consisting of alkyl, alkenyl, aryl, alkaryl, aralkyl which may optionally contain O, N, S or mixtures thereof and wherein the reaction is carried out at temperatures varying from ambient to about 250° C. under pressures varying from ambient or autogenous for a time sufficient to obtain the desired additive product of reaction and where the reaction is carried out in molar ratios of reactants varying from equimolar to more than molar to less than molar.

11. The additive product of reaction in accordance with claim 10 wherein said product of reaction is prepared from aqueous sodium dibutyl dithiocarbamate and 2-chloroethyl methyl ether.

12. The additive product of reaction in accordance with claim 10 wherein said product of reaction is prepared from aqueous sodium dibutyl dithiocarbamate and 2-chloroethyl ether.

* * * * *